US009004440B2

(12) United States Patent
May

(10) Patent No.: US 9,004,440 B2
(45) Date of Patent: Apr. 14, 2015

(54) GROUND-ANCHORED UMBRELLA STAND

(71) Applicant: May Geraetebau GmbH, Betzenweiler (DE)

(72) Inventor: Karl-Heinz May, Betzenweiler (DE)

(73) Assignee: May Geraetebau GmbH, Betzenweiler (DE)

( * ) Notice: Subject to any disclaimer, the term of this patent is extended or adjusted under 35 U.S.C. 154(b) by 140 days.

(21) Appl. No.: 13/722,124

(22) Filed: Dec. 20, 2012

(65) Prior Publication Data

US 2013/0161474 A1 Jun. 27, 2013

(30) Foreign Application Priority Data

Dec. 21, 2011 (DE) ..... 10 2011 121 878

(51) Int. Cl.
*F16M 13/00* (2006.01)
*E02D 27/42* (2006.01)

(52) U.S. Cl.
CPC ..... *E02D 27/42* (2013.01)

(58) Field of Classification Search
CPC ..... E02D 27/42
USPC ..... 248/530, 519, 534, 545, 353, 156; 52/295, 296, 298
See application file for complete search history.

(56) References Cited

U.S. PATENT DOCUMENTS

| | | | | | |
|---|---|---|---|---|---|
| 3,141,620 | A * | 7/1964 | Guggemos | 362/220 |
| 3,311,333 | A * | 3/1967 | Galloway | 52/295 |
| 3,364,635 | A * | 1/1968 | Guggemos | 52/28 |
| RE26,995 | E * | 12/1970 | Guggemos | 52/122.1 |
| 3,671,738 | A * | 6/1972 | Beachley | 362/431 |
| 4,079,559 | A * | 3/1978 | Tenbrummeler | 52/295 |
| 4,590,719 | A * | 5/1986 | McKibbin | 52/116 |
| 5,535,978 | A * | 7/1996 | Rodriguez et al. | 248/530 |
| 6,216,414 | B1 * | 4/2001 | Feldberg | 248/525 |
| 7,462,117 | B2 * | 12/2008 | White et al. | 473/481 |
| 7,779,589 | B2 * | 8/2010 | Salman | 52/298 |

FOREIGN PATENT DOCUMENTS

| | | |
|---|---|---|
| DE | 27 25 057 | 8/1988 |
| DE | 201 14 229 | 11/2001 |

* cited by examiner

*Primary Examiner* — Anita M King
(74) *Attorney, Agent, or Firm* — Lowe Hauptman & Ham, LLP

(57) ABSTRACT

A ground-anchored umbrella stand comprises a base unit which is to be anchored in the ground and includes a soil sleeve extending into the soil. A pole mounting unit, in which the pole is inserted, is fastened to the base unit so as to be able to tilt relative to the base unit in all directions in space. An adjustment and locking mechanism between the base unit and the pole mounting unit allows tilting and aligning the pole mounting unit in all directions.

17 Claims, 6 Drawing Sheets

GROUND-ANCHORED UMBRELLA STAND

CROSS REFERENCE TO RELATED APPLICATION

This application claims the priority of German Patent Application No. 10 2011 121 878.9 filed on Dec. 21, 2011 in the German Patent and Trade Mark Office (DPMA), the disclosure of which is incorporated herein in their entirety by reference.

FIELD OF THE INVENTION

The invention relates to a ground-anchored umbrella stand comprising a base part which is to be anchored in the ground and includes a soil sleeve extending into the soil.

BACKGROUND

Umbrella stands, in particular those for large umbrellas for use in cafés or restaurants, are often so-called cantilevered umbrellas in which the pole is situated at the side of the umbrella covering so that the sheltered area underneath the umbrella is not affected by the pole. In umbrellas of this type, the pole is subjected to bending so that a high force is exerted to the umbrella stand. For this reason, the umbrella stands are anchored in the soil usually by setting them in concrete. The requirements to the technician, however, are relatively high in this case as it is of importance to align the umbrella stand exactly in the vertical line.

SUMMARY

It is the object of the invention to provide a ground-anchored umbrella stand which simplifies the installation of the umbrella stand in the soil, namely its embedding in the soil.

The umbrella stand according to the present invention comprises a base part which is to be anchored in the ground and comprises a soil sleeve extending into the soil in that a pole mounting unit for the umbrella pole is provided which extends upwards with respect to the ground and is fastened to the base unit via an adjustment and locking mechanism. The adjustment and locking mechanism allows the pole mounting unit to tilt relative to the base unit in all directions in space.

Other than in prior art, the ground-anchored umbrella stand of the invention does not have to be set in concrete in the exact vertical line. Rather, it is possible to tilt the pole mounting unit receiving the umbrella pole to any desired degree with respect to the soil sleeve and hence to adjust it in space. This is a major advantage in particular with cantilevered umbrellas as the latter apply an extremely one-sided load to the umbrella stand due to their out-of-center force and induce a slight inclination of the pole owing to possible flexibilities in the umbrella stand and in the pole, even if the umbrella stand had been initially anchored in perpendicular orientation. The umbrella stand according to the invention, however, allows an exact alignment of the pole mounting unit via the adjustment and locking mechanism when the umbrella is inserted, i.e. in the load situation. Therefore, this adjustment process can be performed in the mounted state of the pole, as the pole mounting unit is fastened to the base unit. In the case of any settlement processes occurring over time in the ground or slight settlement processes in the umbrella stand, for instance, a readjustment is possible, too.

The adjustment of the pole mounting unit relative to the base unit can be performed in continuously variable fashion.

The adjustment and locking mechanism comprises at least three bearings between the base unit and the pole mounting unit which allow the pole mounting unit to perform a tilting motion.

Two of the three bearings, to be more precise at least two of the three bearings can be adjustable to allow the aligning process.

The adjustment of the pole mounting unit is carried out, for instance, by means of a height adjustment of two of the at least three bearings, whereby a tilting motion of the pole mounting unit can take place in any direction.

The adjustment and locking mechanism can be provided in one plane only, in fact between the pole mounting unit and the base unit. This means that there are no different bearings which are stacked one upon another and can tilt with respect to one another. It is rather the socket surface of the pole mounting unit which can tilt relative to the socket surface of the base unit.

According to one option, all bearings are of identical design, reducing the cost for the umbrella stand.

There are various possibilities to realize one or more of the bearings. These will be explained in the following.

The bearing(s) is/are realized as a screw-type adjustment means, for example, which is able to tilt the pole mounting unit with respect to the base part to varying degrees. The screw-type adjustment means allow a continuously variable adjustment and an easy alignment. Such screw-type adjustment means can be combined as desired with any kinds of bearings.

One type of bearing is an articulated lever which is continuously variable and arranged for locally raising and lowering the pole mounting unit. The embodiment makes provision that the articulated lever is provided between the base unit and the pole mounting unit and hence sheltered from above.

According to one option one or all bearings can be provide as a wedge-type adjustment mechanism to achieve a local raising and lowering of the pole mounting unit. Such a wedge-type adjustment mechanism, for instance, may be realized such that a wedge can be shifted between the base unit and the pole mounting unit by means of a screw-type adjustment means in order to locally raise and lower the pole mounting unit and hence to tilt it. As an alternative to a mere wedge, it is also possible to provide a groove which extends obliquely upward and is engaged by a counter-piece provided on the base part or the pole mounting unit. Such a groove allows achieving an interlocking fit in both vertical directions.

Another option of the invention provides to equip the one or all bearings with a spring unit acting between the pole mounting unit and the base unit. The preferred variant makes provision to dispose the spring unit such that it strives to raise the pole mounting unit. An additionally provided hold-down element, in particular in the form of a bolt, pushes the pole mounting unit in the opposite direction, i.e. downwards, to adjust the compression of the spring unit.

The potentially simplest form of a bearing is a so-called ball-head screw. Such a ball-head screw has a ball head, e.g. with a drive geometry (usually a hole with a non-circular wall) realized in the ball head or on the front-side end of the bolt shaft in order to rotate the bolt. The head is supported in a seat either in the base unit or in the pole mounting unit, and the shaft is screwed in a nut. Adjusting the ball-head screw results in an effect comparable with a spindle bringing about the height adjustment and, as a consequence, the tilting motion of the pole mounting unit. By the pole mounting unit being able to tilt in all directions in space, the ball screw is a sort of ball joint which allows tilting in all directions.

A simple way of supporting the ball head is achieved in that it is received in a laterally protruding flange of the pole mounting unit so as to be immovable in vertical direction, i.e. is retained in both opposite vertical directions, whereas the ball head must be able to rotate, of course. The ball head is retained, for example, between the flange and a part connected thereto.

The flange can be a double flange comprising two parts axially lying on top of each other and receiving the ball head between them so that it is supported in both vertical directions. A separate ball socket for supporting the ball head is no longer necessary.

Additional locking elements provided separately from the bearings serve to fix the pole mounting unit in the desired orientation. This means that the bearings themselves may be used for adjustment, and the final position will be fixed via the locking elements so that these will also absorb the high wind loads or the like occurring in use. In the simplest case, which is not to be understood in limiting sense, however, the adjustment mechanism raises or lowers the pole mounting unit at different points; after the aligning process, the locking elements, usually bolts, clamp the pole mounting unit to the base unit with the adjustment mechanism interposed therebetween.

The pole mounting unit may have a receiving tube with a flange protruding therefrom at one side.

The flange may comprise a mounting flange integrally connected to the receiving tube as well as a bearing flange tiltably retained on the base unit via the bearings. The mounting and bearing flanges are connected to each other through a pivot bearing which allows pivoting the receiving tube at least approximately into the horizontal plane. This is of advantage especially with heavy-weight umbrellas because the receiving tube can be tilted. In the tilted position, the umbrella pole will be inserted and then the pole erected about the pivot bearing, i.e. it is swiveled into the vertical position. Subsequently, the mounting flange and the bearing flange are fully secured to each other to prevent any tilting in backward direction.

DETAILED DESCRIPTION

Figure 1:
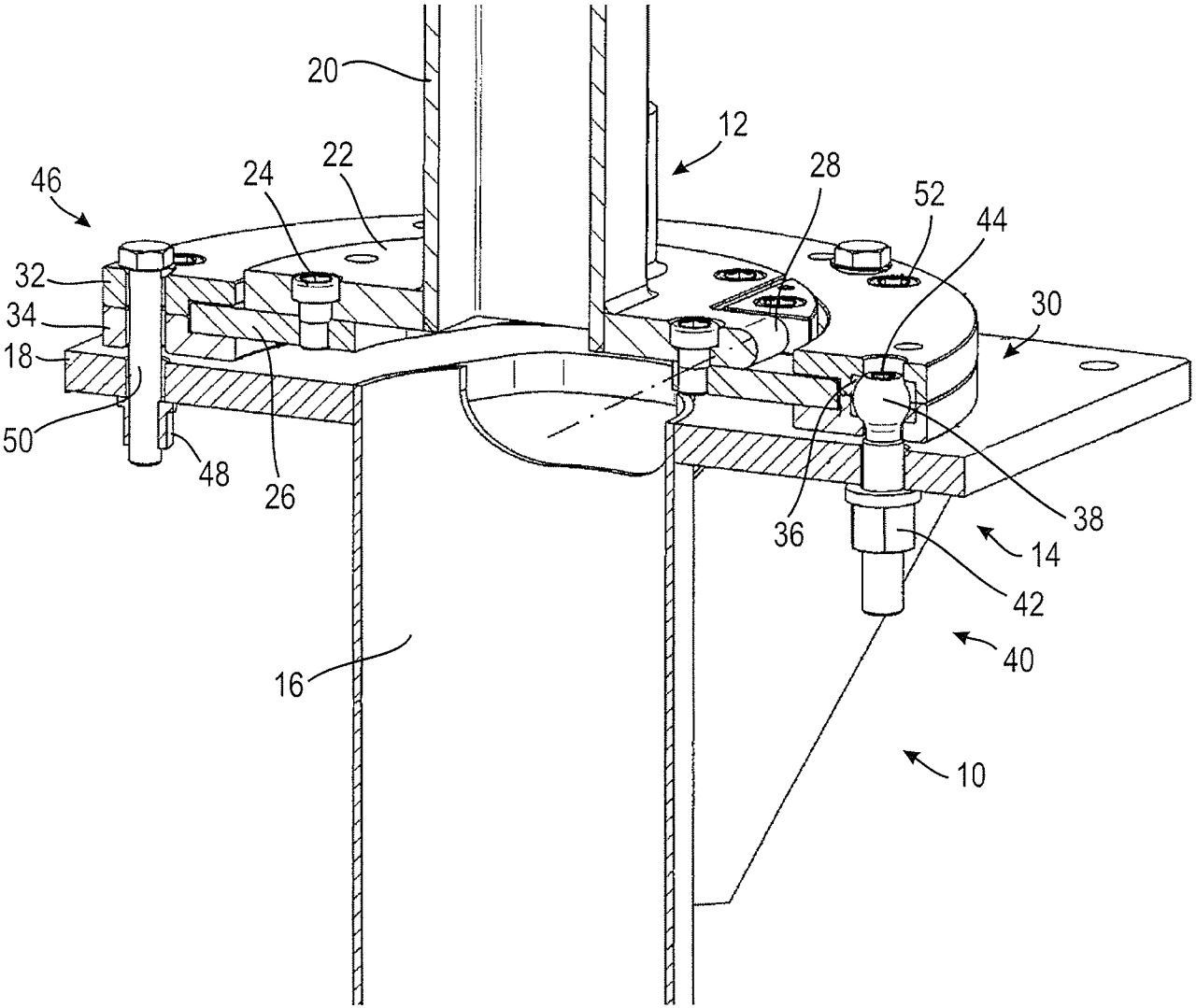
FIG. 1 shows a longitudinal sectional view through a first embodiment of the umbrella stand according to the invention.

FIG. 1 illustrates a ground-anchored umbrella stand as it is used for supporting large umbrellas for restaurants, for instance. The ground-anchored umbrella stand is e.g. suitable for supporting cantilevered large umbrellas.

The umbrella stand essentially comprises three portions, i.e. a base unit 10 anchored in the ground, a pole mounting unit 12 extending upward above the ground as well as an adjustment and locking mechanism 14 between the base unit 10 and the pole mounting unit 12.

The adjustment and locking mechanism 14 serves for aligning the pole mounting unit 12 in the vertical line, in fact in all directions in space.

The base unit 10 comprises a tube 16 which is fastened in the soil by setting it in concrete and has its upper end provided with a welded flange 18 which is flush with the ground or rests thereon.

The pole mounting unit 12 which can tilt relative to the base unit 10 comprises a receiving tube 20 which has an angular design according to the preferred embodiment to prevent the pole from rotating within the tube 20.

A mounting flange 22 is welded to the receiving tube 20 in the region of the lower end thereof. The mounting flange 22 is provided with an opening, too. Said opening is adapted to the outer dimensions of the receiving tube 20.

The mounting flange 22 is locked to an underlying bearing flange 26 via several fastening means 24 in the form of bolts. However, there are not only the fastening means 24 which serve for attaching the mounting flange 22 to the bearing flange 26; rather, the mounting flange 22 is coupled to the bearing flange 26 via a pivot bearing 28 symbolized through a center line.

Figure 2:
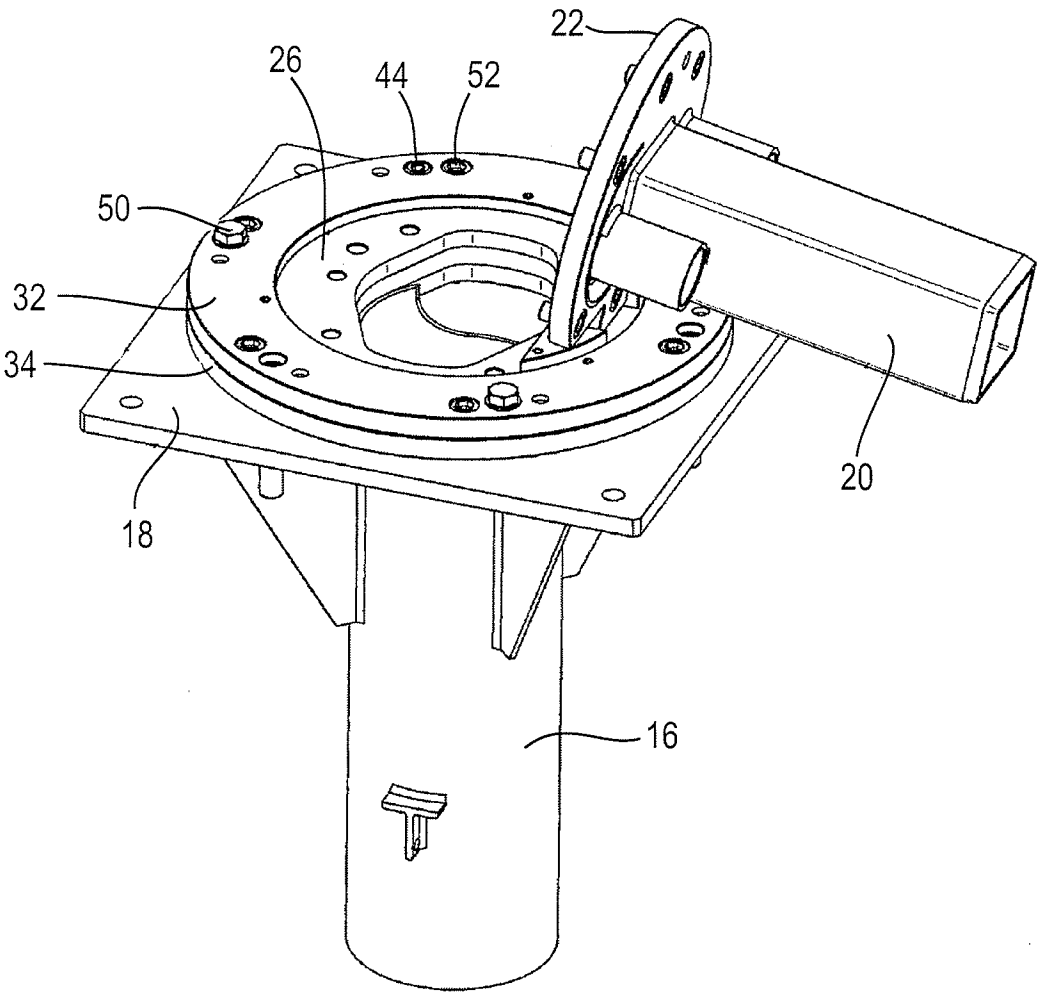
FIG. 2 shows a side view of the umbrella stand according to FIG. 1 with the pole mounting unit being tilted sideward.
Figure 3:
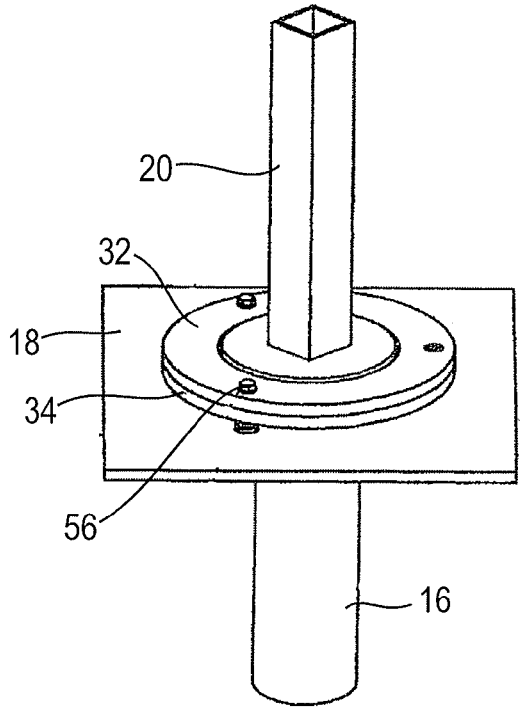
FIG. 3 shows a perspective top view of an umbrella stand according to a second embodiment.
Figure 4:
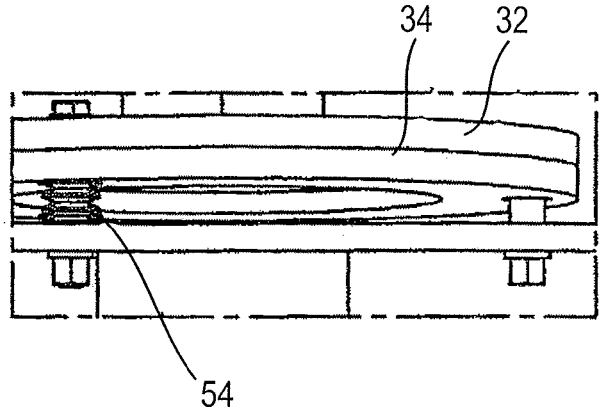
FIG. 4 shows a side view of the umbrella stand according to FIG. 3.
Figure 5:
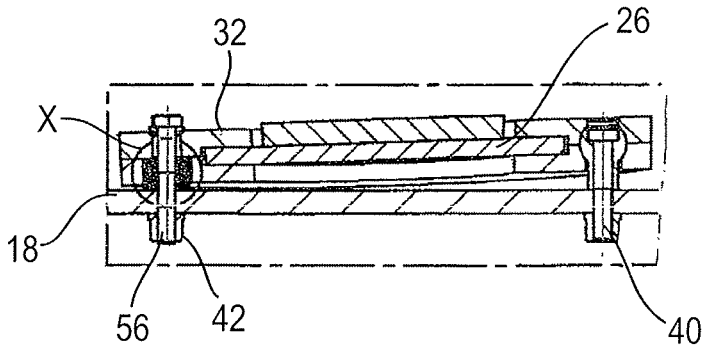
FIG. 5 shows a longitudinal sectional view through the umbrella stand according to FIG. 4.
Figure 6:
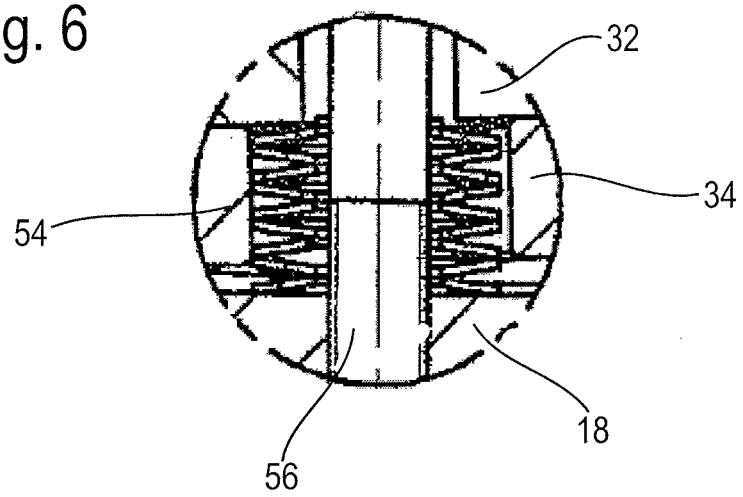
FIG. 6 shows an enlarged view of the area in FIG. 5 labeled with X.

Said pivot bearing 28 allows a tilting motion of the mounting flange 22 complete with the receiving tube 20 about the pivot bearing 28 from the perpendicular position shown in FIG. 1 to the horizontal position shown in FIG. 2 where it is very easy to insert a pole in the receiving tube 20.

The outer edge of the bearing flange 26, which in particular is realized in circular shape, is clamped or retained between a double flange 30 formed by two parts axially lying on top of each other, in fact an upper ring 32 and a lower ring 34. Both rings 32, 34 have a surrounding groove on their inner side in the region of the outer edge of the bearing flange 26, and the edge of the bearing flange 26 is received in said groove.

Further, each of the upper and lower rings 32 and 34 comprises recesses on the facing end faces which lie opposite each other and are radially spaced from the bearing flange 26, in order to define a receiving space 36 for the ball head 38 of a ball-head screw 40.

The receiving space 36 may also be defined in that a surrounding groove is formed in the two rings 32, 34.

The height of the receiving space 36 is preferably realized such that the ball head 38 is accommodated in the receiving space 36 so as to be essentially free of play in axial direction, i.e. perpendicular to the horizontal. The shaft of the bolt 40 extends through an opening in the lower ring 34 and through an opening in the flange 18 towards the ground.

A nut 42 is welded to the lower side of the flange 18.

The ball head 38 has its upper side provided with a drive geometry 44 which is in particular a hexagonal socket. In the region of the drive geometry 44, the upper ring 32 has a recess so that the ball-head screw 40 is accessible from above and can be rotated by inserting a tool.

In combination with the nut 42, the ball-head screw 40 represents a bearing between the base unit 10 and the pole mounting unit 12.

Three of those bearings are provided on the circumference in uniform distribution.

Further, the circumference between two bearings is provided with locking elements 46 in the form of bolts and nuts 48, the latter being fastened to the lower side of the flange 18. The bolts 50 extend from the upper side of the ring 32 through the ring 34 and through the flange 18 into the respective nut 48. It is preferred that three of these very stable locking elements 46 are provided.

The three bearings and the circumferentially interposed locking elements 46 define an adjustment and locking mechanism between the pole mounting unit 12 and the base unit 10 which allows to tilt the receiving tube 20 in each direction and to exactly adjust the receiving tube 20 and hence the umbrella pole in case of poor alignment of the tube 16 with respect to the vertical line.

The adjustment is performed in that the locking elements 46 are unfastened first, i.e. there is an axial clearance between the bolt head of the bolts 50 and the upper side of the ring 32. Subsequently, one or more bearings are adjusted depending on the inclination of the receiving tube 20 and the pole received therein.

In the exemplary embodiment which is shown here, the ball-head screw(s) 40 is/are screwed deeper into the nut 42 or to a lesser depth into the respective nut 42, i.e. are moved upwards or downwards. In the course of the adjustment, the double flange 30 and the bearing flange 26 likewise move upwards or downwards so that a tilting motion is brought about.

In the simplest case, one ball-head screw 40 which so to speak serves as a base fixing point may remain unadjusted, as the ball head 38 follows a tilting motion of the double flange 30 in each direction, and then the two remaining ball-head screws 40 are adjusted to allow the alignment of the receiving tube 20 in the vertical line. For that reason, it would be conceivable to immovably fasten a ball-head screw 40 to the flange 18 or to use a kind of ball-head bolt.

In the preferred embodiment, however, three identical bearings are provided, i.e. three ball-head screws 40.

If the receiving tube 20 has been adjusted, the locking elements 46 are fixed by firmly screwing down the bolts 50 against the ring 32. In doing so, the aligned position is stably fixed, even in case of high wind loads.

It is only a compressive force which is exerted on the ball-head screw 40, the total tensile force is introduced into the locking elements 46.

Even the relatively short retaining screws 52 fixing the two rings 32, 34 to each other are not subjected to wind loads or the like when the locking elements 46 have been adjusted and fixed.

For taking down the umbrella, the fastening means 24 are unfastened and the umbrella complete with the receiving tube 20 can be tilted about the pivot bearing 28, see FIG. 2.

In the remaining three embodiments, the bearings have a slightly different design in each case, but the locking elements 46 are realized as in FIG. 1 so that they have been graphically omitted for simplification.

In the embodiment according to FIGS. 3 to 6, a spring unit 54 made up of a Belleville spring pack (see FIG. 6) is provided between the double flange 30 and the flange 18 in the region of at least two bearings. In the exemplary embodiment which is shown, the Belleville springs surround the bolt 56 which penetrates the double flange 30 from above and is screwed into the nut 42.

For a safe accommodation of the spring unit 54, a corresponding bore in the lower ring 34 is provided in this embodiment; said ring houses the spring unit 54 in part so that it presses against the upper ring 32 only.

The spring unit 54 has a relatively high stiffness and strives to locally push the pole mounting unit in upward direction. The bolt 56 serves as a hold-down element and locally adjusts the compression of the spring unit 54 in a continuously variable manner.

In the embodiment according to FIGS. 3 to 6, three identical ones of those bearings in the form of bolts 56 and spring units 54 may be provided, again uniformly distributed along the circumference.

As the spring units 54 are relatively complex and expensive, however, it would be reasonable to realize one of the three bearings as a ball-head screw 40.

This ball-head screw may, but need not, be adjustable in height and can act as a non-adjustable base tilt bearing.

For adjustment, the bolts 56 are screwed in to a greater or lesser extent in order to adjust the height of the double flange at this place and produce a tilting motion.

The locking elements 46, while preferably additionally provided, may possibly be omitted or provided at least only in the region of the ball-head screw 40. In case no locking elements 46 are used, the respective bearing simultaneously defines the locking element and hence an adjustment and locking mechanism.

Figure 7:
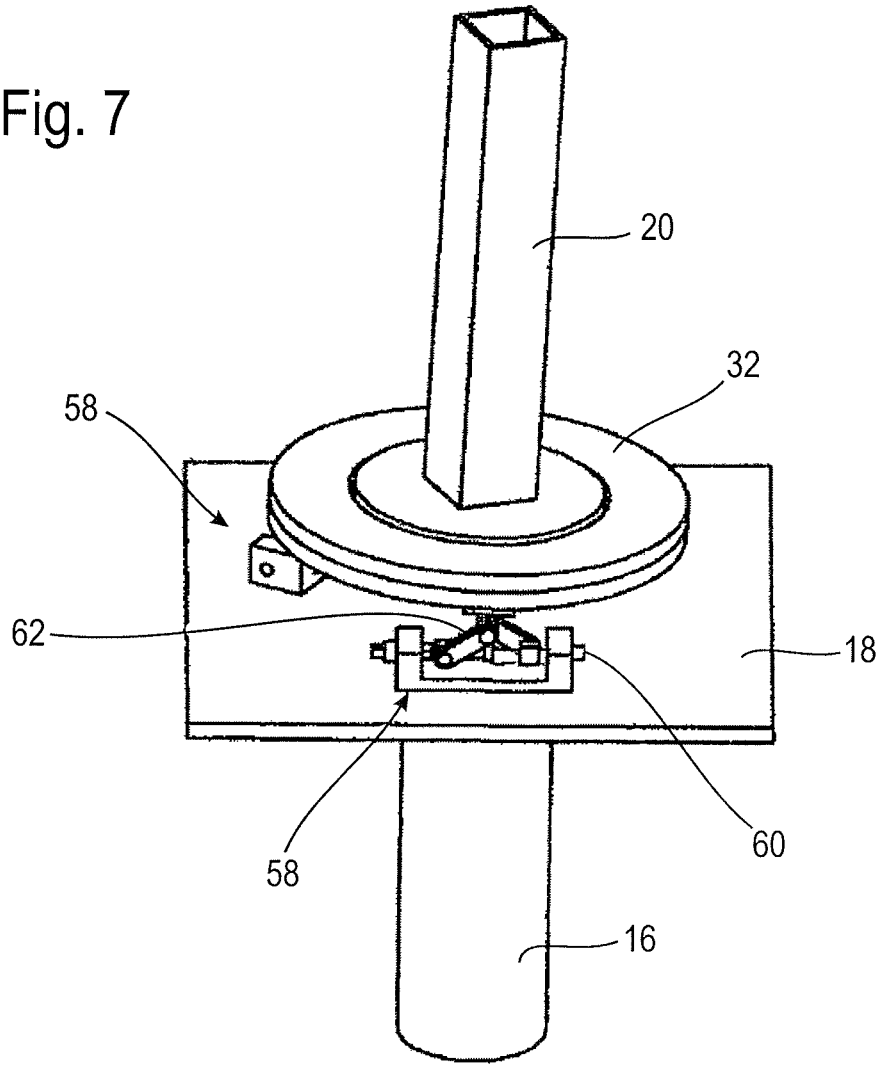
FIG. 7 shows a perspective top view of an umbrella stand according to a further embodiment of the invention.
Figure 8:
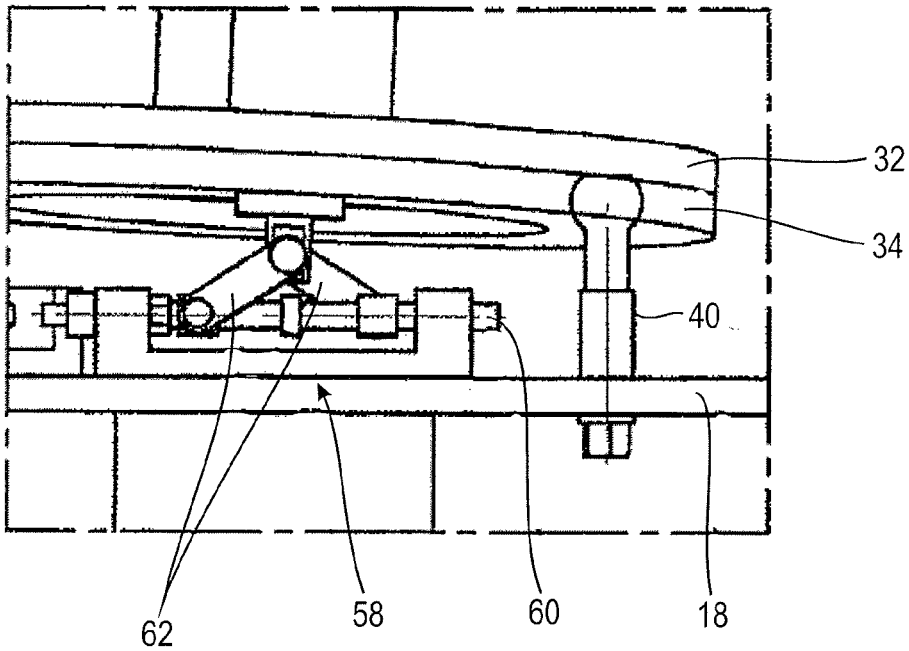
FIG. 8 shows a side view of the umbrella stand according to FIG. 7 in the region of the bearing.

The embodiment according to FIGS. 7 and 8 likewise makes provision of three bearings, and at least two bearings among these are realized as articulated levers 58. These articulated levers 58 are disposed between the base unit 10, i.e. on the upper side of the flange 18, and the lower side of the associated flange of the pole mounting unit 12, here of the lower ring 34.

Any height adjustment and hence tilting of the pole mounting unit 12 can be achieved by the articulated lever which comprises an adjustment spindle 60 that makes two pivotally connected levers 62 pivot relative to each other to a greater or lesser extent.

In the exemplary embodiment which is shown, a ball-head screw 40 is provided which constitutes one of the three bearings, in order to save one articulated lever 58. This ball-head screw can also be designed so as to be adjustable in height, but this is not mandatory.

Figure 9:
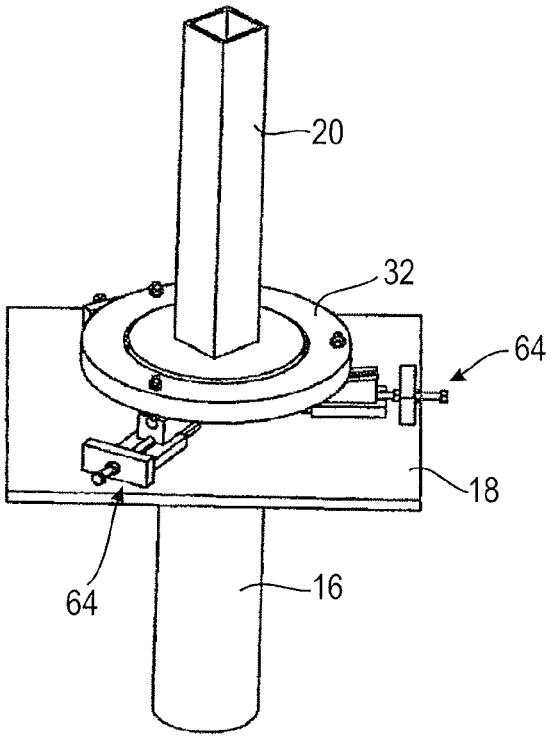
FIG. 9 shows a perspective top view of an umbrella stand according to a fourth embodiment of the invention.
Figure 10:
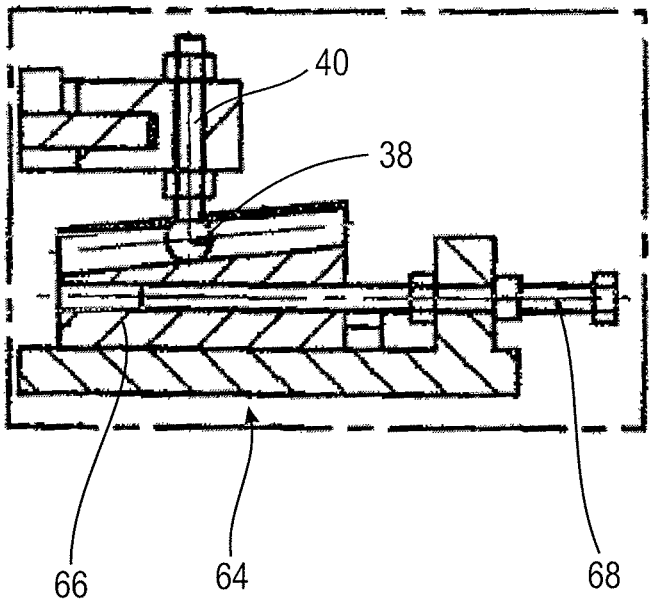
FIG. 10 shows a sectional view through a bearing used in the umbrella stand according to FIG. 9.

In the embodiment according to FIGS. 9 and 10, wedge-type adjustment mechanisms 64 between the base unit 10 and the pole mounting unit 12 are provided. Here, a wedge 66 can be adjusted via a drive spindle 68, and a ball head 38 of a ball-head screw 40, for instance, which is secured in a flange on the pole mounting unit 12, slides on the wedge surface.

In order to prevent the ball head 38 from lifting off from the wedge surface in upward direction, it is contemplated to realize a C-shaped groove, extending obliquely relative to the horizontal, on the upper side of the wedge 66; in said groove, the ball head 38 can be moved.

Locking elements 46 may or should be provided in this embodiment, too.

In order to secure the construction against radial displacement, either locking elements must be provided or only two wedge-type mechanisms shall be used in combination with a fixed ball-head screw.

It goes without saying that the various bearings can also be combined as desired, and bearing parts may also be fastened to the respectively other components of the umbrella stand; to give an example, the ball head 38 in the embodiment according to FIG. 1 could be accommodated in the flange 18, whereas the nut 42 is attached to the flange of the pole mounting unit 12.

What is claimed is:

1. A ground-anchored umbrella stand, comprising:

a base unit configured to be anchored in the ground, and including a soil sleeve extending into the ground;

a pole mounting unit configured to
mount an umbrella pole,
extend upwards with respect to the ground, and
be fastened to the base unit via an adjustment and locking mechanism;

the adjustment and locking mechanism configured to allow the pole mounting unit to tilt relative to the base unit in all directions in space; and at least three bearings provided between the base unit and the pole mounting unit, and configured to allow the pole mounting unit to perform a tilting motion, wherein at least one of the bearings is realized as a ball-head screw.

2. The umbrella stand according to claim 1, wherein at least two of the bearings are adjustable in height.

3. The umbrella stand according to claim 1, wherein all bearings are of identical design.

4. The umbrella stand according to claim 1, wherein at least one of the bearings comprises screw-type adjustment means for tilting the pole mounting unit at varying degrees relative to the base unit.

5. The umbrella stand according to claim 1, wherein at least one of the bearings is realized as an articulated lever for locally raising and lowering the pole mounting unit.

6. The umbrella stand according to claim 1, wherein at least one of the bearings is realized as a wedge-type adjustment mechanism for locally raising and lowering the pole mounting unit.

7. The umbrella stand according to claim 1, wherein at least one of the bearings comprises:

a spring unit between the pole mounting unit and the base unit, and a hold-down element configured to adjust compression of the spring unit.

8. The umbrella stand according to claim 7, wherein the spring unit being positioned such that the spring unit exerts an upward force to the pole mounting unit.

9. The umbrella stand according to claim 1, wherein the pole mounting unit includes a laterally protruding flange, and wherein the ball head screw includes a ball head which is received in the laterally protruding flange of the pole mounting unit to be immovable in a vertical direction.

10. The umbrella stand according to claim 9, wherein the flange is a double flange comprising two parts axially lying on top of each other, and receiving the ball head therebetween.

11. A ground-anchored umbrella stand, comprising:

a base unit configured to be anchored in the ground, and including a soil sleeve extending into the ground;

a pole mounting unit configured to
mount an umbrella pole,
extend upwards with respect to the ground, and
be fastened to the base unit via an adjustment and locking mechanism;

the adjustment and locking mechanism configured to allow the pole mounting unit to tilt relative to the base unit in all directions in space;

at least three bearings provided between the base unit and the pole mounting unit, and configured to allow the pole mounting unit to perform a tilting motion; and locking elements which are
provided additionally to and separate from the bearings, and
configured to fix the pole mounting unit in a desired orientation.

12. The umbrella stand according to claim 11, wherein at least two of the bearings are adjustable in height.

13. The umbrella stand according to claim 11, wherein all bearings are of identical design.

14. The umbrella stand according to claim 11, wherein at least one of the bearings comprises screw-type adjustment means for tilting the pole mounting unit at varying degrees relative to the base unit.

15. The umbrella stand according to claim 11, wherein at least one of the bearings is realized as a ball-head screw.

16. The umbrella stand according to claim 15, wherein the pole mounting unit includes a laterally protruding flange, and wherein the ball head screw includes a ball head which is received in the laterally protruding flange of the pole mounting unit to be immovable in a vertical direction.

17. The umbrella stand according to claim 16, wherein the flange is a double flange comprising two parts axially lying on top of each other, and receiving the ball head therebetween.

* * * * *